United States Patent [19]

Jenkins

[11] Patent Number: 4,904,032

[45] Date of Patent: Feb. 27, 1990

[54] SHELF SUPPORT SYSTEM FOR A REFRIGERATOR CABINET

[75] Inventor: Thomas E. Jenkins, Louisville, Ky.

[73] Assignee: General Electric Company, Louisville, Ky.

[21] Appl. No.: 294,309

[22] Filed: Jan. 9, 1989

[51] Int. Cl.[4] ..... A47B 88/00

[52] U.S. Cl. ..... 312/350; 108/107; 108/110; 211/134

[58] Field of Search ..... 312/214, 330 R, 350; 211/134; 108/107, 110, 143

[56] References Cited

U.S. PATENT DOCUMENTS

| | | | |
|---|---|---|---|
| Re. 19,798 | 12/1935 | Copeman . | |
| 1,191,198 | 7/1916 | Kuhn et al. . | |
| 2,078,681 | 4/1937 | Otte | 211/134 X |
| 2,287,611 | 6/1942 | Harbison | 211/134 X |
| 2,611,675 | 9/1952 | Palmer . | |
| 2,630,400 | 3/1953 | Ring . | |
| 3,220,364 | 11/1965 | Sandin . | |
| 3,279,876 | 10/1966 | St. Cyr . | |
| 3,311,072 | 3/1967 | Pattison . | |
| 3,397,934 | 8/1968 | Dushek . | |

*Primary Examiner*—Joseph Falk

*Attorney, Agent, or Firm*—Frederick P. Weidner; Radford M. Reams

[57] ABSTRACT

A plurality of shelf supports is molded integrally with each side wall of a refrigerator cabinet liner. Each of the shelf supports on one side wall is in the same horizontal plane as one of the shelf supports on the other side wall. Each of the shelf supports includes an upper surface for supporting a fixed shelf. Each of the shelf supports has a recess extending between its upper and lower surfaces to function as a stop for preventing removal of a fixed shelf through receiving a portion of the fixed shelf therein. Each of the shelf supports has a projection extending downwardly therefrom forwardly of the recess for engaging a portion of a slidable shelf supported on the upper surface of the shelf support thereof. A single ladder track is mounted on the rear wall of the liner to support one side of a cantilever half shelf, which has its other side supported on the upper surface of one of the shelf supports. The cantilever half shelf has a portion cooperating with the recess in the shelf support to prevent the cantilever half shelf from swinging off of the upper surface of the shelf support. Thus, the same shelf support system supports fixed shelves, slidable shelves, and cantilever half shelves.

13 Claims, 5 Drawing Sheets

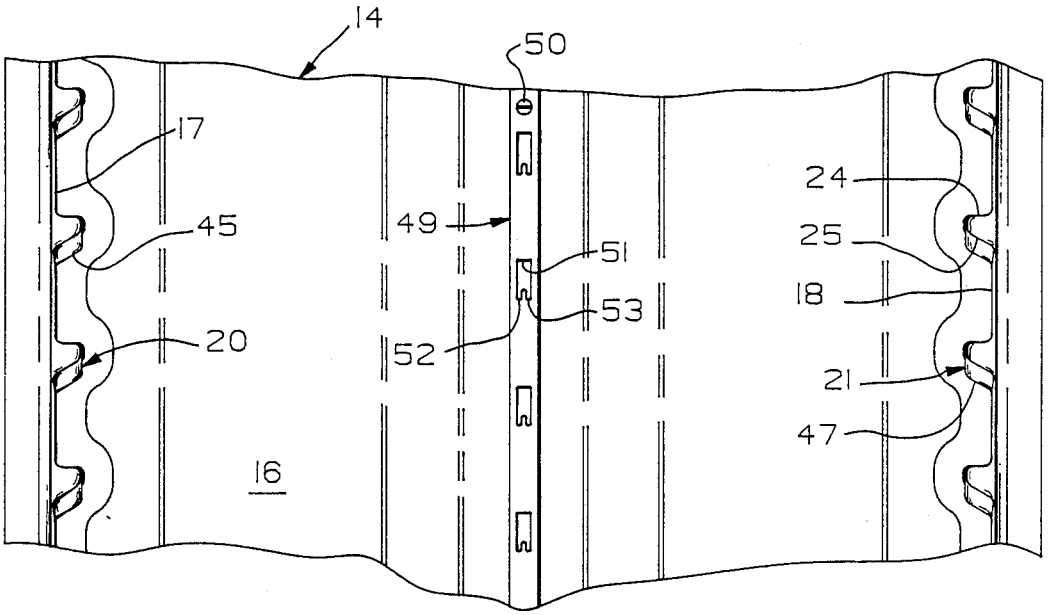
FIG. 10
FIG. 11
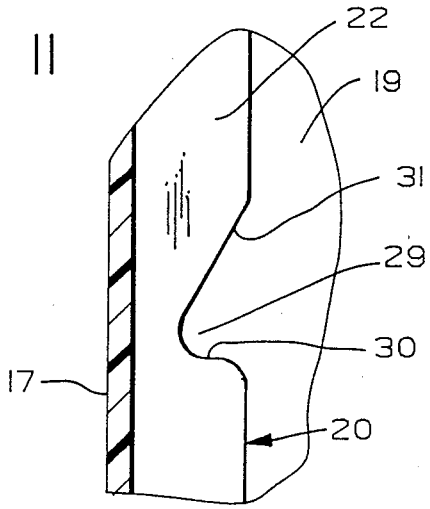

SHELF SUPPORT SYSTEM FOR A REFRIGERATOR CABINET

FIELD OF THE INVENTION

This invention relates to a shelf support system for a refrigerator cabinet and, more particularly, to shelf supports on a liner of a refrigerator cabinet capable of supporting fixed shelves, slidable shelves, and cantilever half shelves.

BACKGROUND OF THE INVENTION

A refrigerator manufacturer usually offers various priced models. The least expensive models have fixed shelves in the refrigerator cabinet. The intermediate priced models normally have slidable shelves that may be partially withdrawn by a user to enable easier access to articles supported on the rear portion of the slidable shelves. The most expensive models normally have adjustable shelves so that a user may adjust all of the shelves in accordance with the sizes of the articles supported thereon. These adjustable shelves are preferably cantilever half shelves to enable a user to adjust only one half of the shelf although the user may have two half shelves in the same plane.

The variations in the types of shelves to be supported within a cooling compartment, which is defined by a refrigerator cabinet liner, have previously resulted in a different type of shelf support being employed for each type of shelf. That is, the fixed shelf required one type of shelf support to retain it in its fixed position. The slidable shelves required a different type of shelf support to enable the slidable shelf to be pulled partially from the interior of the cooling compartment and retained in that position. The adjustable cantilever half shelves required support of each of the half shelves intermediate the side walls of the liner and one one of the side walls of the liner. This resulted in three different types of shelf supports being utilized with a refrigerator cabinet of a single size. That is, the same size refrigerator cabinet would have each of the three different types of shelves whereby the manufacturer had to provide three different types of shelf supports.

This caused a substantial expense in forming the refrigerator cabinet liner for the three different priced models. That is, three different types of tooling were required to form the three different types of shelf supports when manufacturing each of the various priced models although each had the same size refrigerator cabinet.

SUMMARY OF THE INVENTION

The shelf support system of the present invention satisfactorily solves the foregoing problems by having the same type of shelf supports on each of the side walls of the refrigerator cabinet liner for use with all three types of shelves. That is, only one type of shelf support is required for a refrigerator cabinet liner irrespective of whether fixed shelves, slidable sleeves, or cantilever half shelves are to be utilized. Of course, with the cantilever half shelves, it also is necessary to have a single track means mounted on the middle of the rear wall of the liner. However, this is merely an addition to the formed liner having the shelf supports on each of its side walls.

The shelf support system of the present invention accomplishes this through having an upper surface for supporting a shelf with holding means to hold the fixed shelf in position whenever the fixed shelf is supported on an upper surface of the shelf support. This same holding means also prevents a cantilever half shelf from swinging off of the upper surface when the cantilever half shelf is supported on the upper surface and by the single track means mounted on the middle of the rear wall of the liner. The shelf support has stopping means for stopping movement of a slidable shelf when a slidable shelf is mounted on the upper surface of the shelf support.

An object of this invention is to provide a common liner for a plurality of refrigerator cabinet models.

Another object of this invention is to provide a shelf support system for supporting fixed shelves, sliding shelves, and cantilever half shelves.

Other objects of this invention will be readily perceived from the following description, claims, and drawings.

BRIEF DESCRIPTION OF THE DRAWINGS

FIG. 10 is a fragmentary front elevational view of a portion of the refrigerator cabinet of FIG. 1; and FIG. 11 is a fragmentary top plan view, partly in section, of a portion of a shelf support of FIG. 1.

DESCRIPTION OF THE PREFERRED EMBODIMENT

Figure 1:
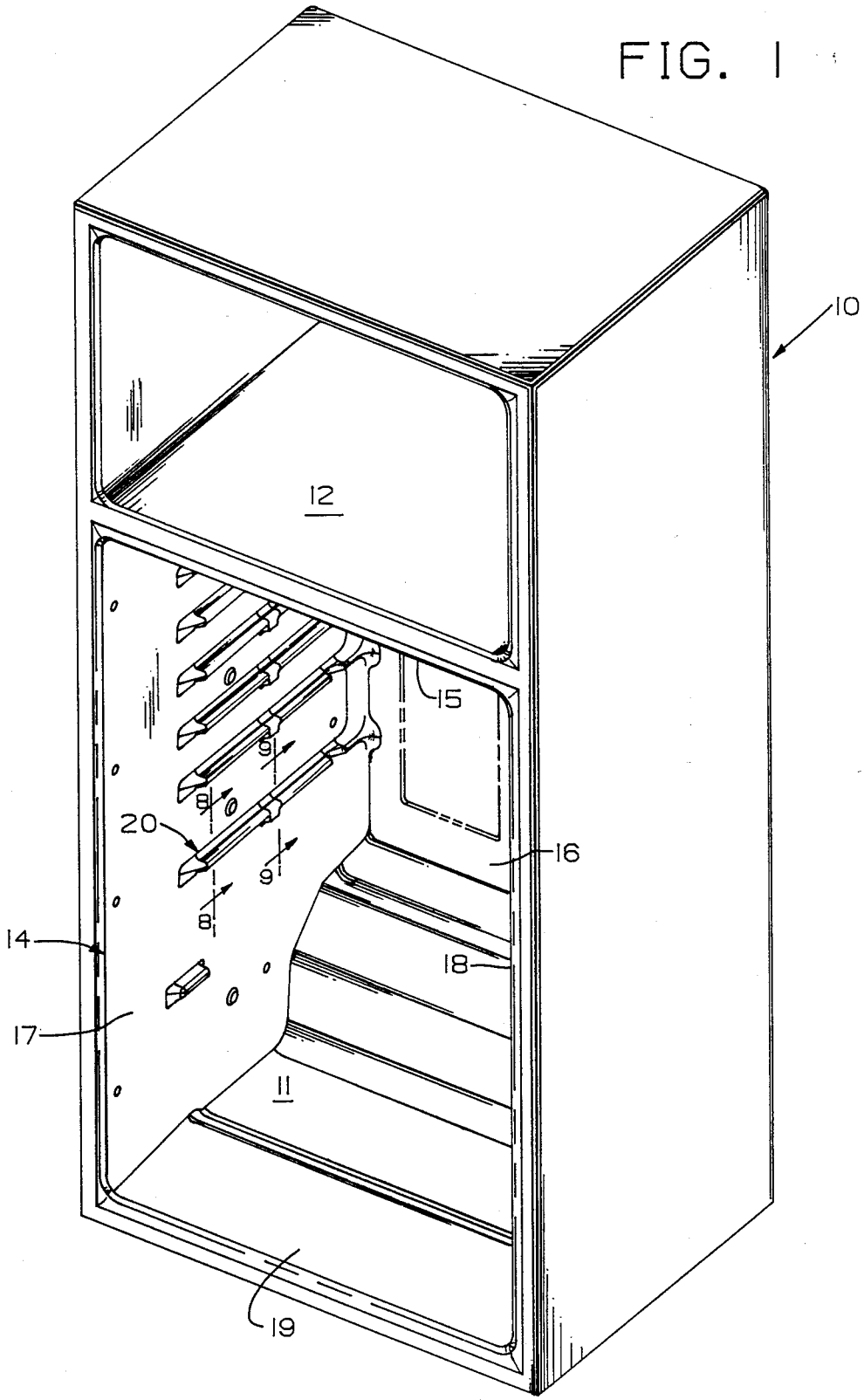
FIG. 1 is a perspective view of a refrigerator cabinet having a shelf support system of the present invention.

Referring to the drawings and particularly FIG. 1, there is shown a refrigerator cabinet 10 having a fresh food compartment 11 and a freezer compartment 12. The fresh food compartment 11 is defined by a liner 14, which is preferably a vacuum formed plastic. The liner 14 includes a top wall 15, a rear wall 16, a pair of substantially parallel side walls 17 and 18, and a bottom wall 19. The walls 15–19 constitute walls of the fresh food compartment 11, which is a cooling compartment.

The side wall 17 has a plurality of shelf supports 20 molded integrally therewith during formation of the liner 14, and the side wall 18 (see FIG. 10) has a plurality of shelf supports 21 molded integrally therewith during formation of the liner 14. Each of the shelf supports 20 and 21 extends longitudinally with each of the shelf supports 20 on the side wall 17 being in the same horizontal plane as one of the shelf supports 21 on the side wall 18.

Figure 7:
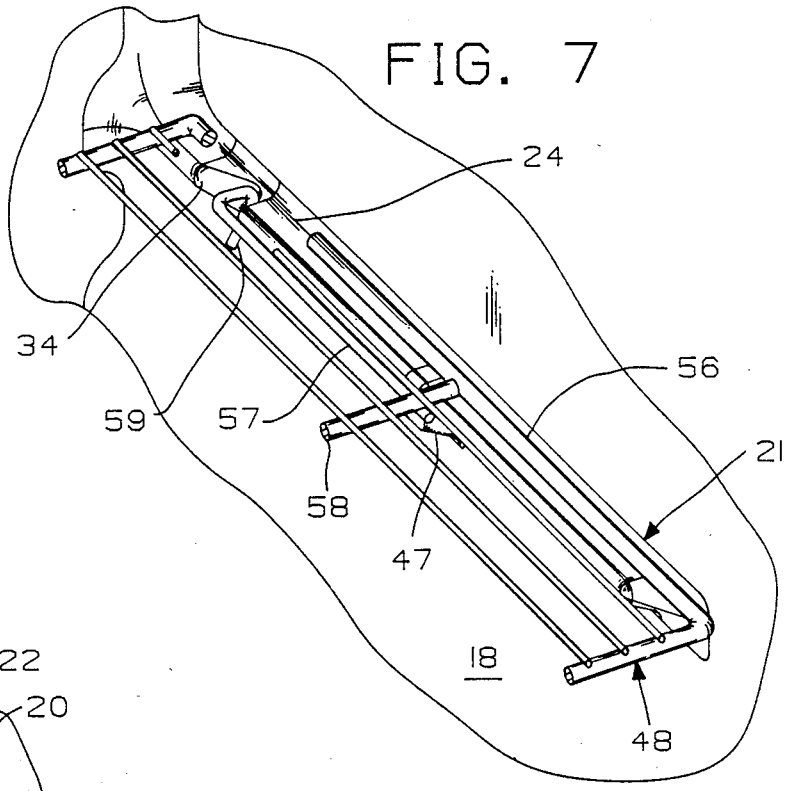
FIG. 7 is a fragmentary perspective view of the other of the side walls of the refrigerator cabinet having one shelf support mounted thereon and supporting one side of a cantilever half shelf.
Figure 8:
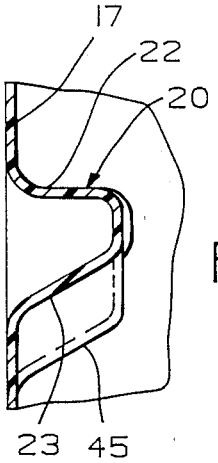
FIG. 8 is a fragmentary sectional view of a portion of a shelf support of FIG. 1 and taken along line 8—8 of FIG. 1.
Figure 9:
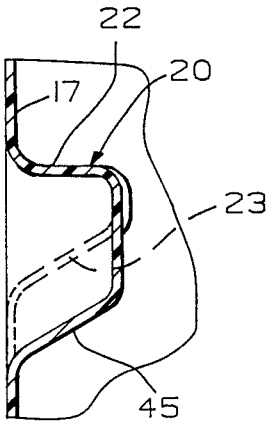
FIG. 9 is a fragmentary sectional view of another portion of the shelf support of FIG. 1 and taken along line 9—9 of FIG. 1.

Each of the shelf supports 20 includes an upper surface 22 (see FIGS. 8 and 9) and a lower surface 23. Each of the shelf supports 21 (see FIG. 7) has an upper surface 24 and a lower surface 25 (see FIG. 10).

Figure 2:
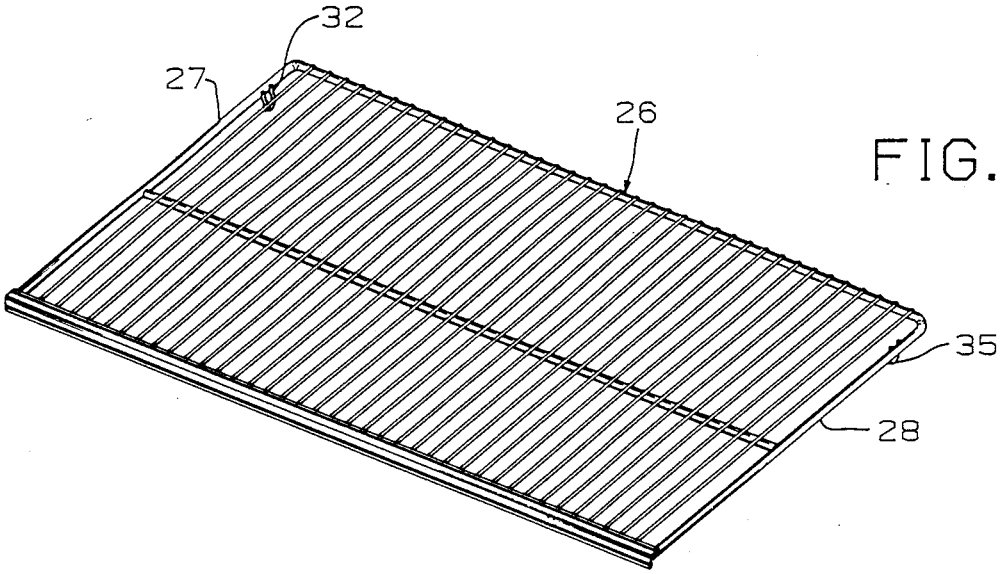
FIG. 2 is a perspective view of a fixed shelf for support by the shelf support system of the refrigerator cabinet of FIG. 1.
Figure 5:
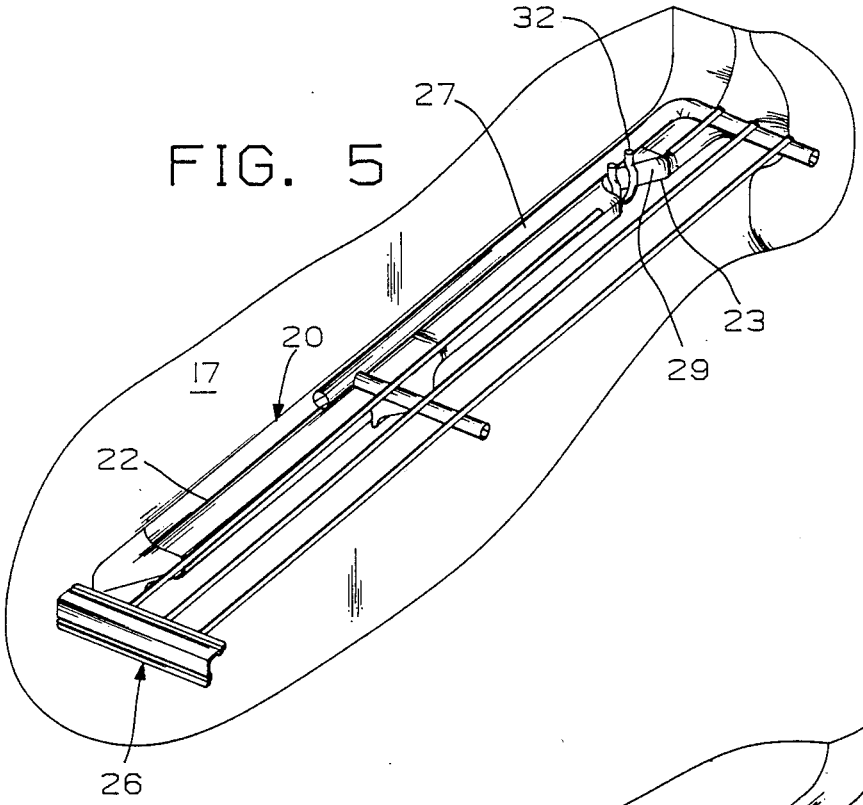
FIG. 5 is a fragmentary perspective view of one of the shelf supports on one of the side walls of the refrigerator cabinet and showing a portion of a fixed shelf supported thereby.

When a fixed shelf 26 (see FIG. 2) is to be supported within the refrigerator cabinet 10 (see FIG. 1), the fixed shelf 26 (see FIG. 2) has a side 27 of its frame resting on the upper surface 22 (see FIG. 5) of one of the shelf supports 20 on the side wall 17. The fixed shelf 26 (see FIG. 2) has a side 28 of its frame supported on the upper surface 24 (see FIG. 10) of one of the shelf supports 21 on the side wall 18 of the refrigerator cabinet 10 (see FIG. 1) in the same horizontal plane as the shelf support 20. Thus, the fixed shelf 26 (see FIG. 2) is disposed substantially horizontal in the refrigerator cabinet 10 (see FIG. 1).

The shelf support 20 (see FIG. 5) has a recess or gap 29 formed therein and extending between the upper surface 22 and the lower surface 23. As shown in FIG. 11, the recess 29 has its front wall 30 extending substantially perpendicular to the side wall 17 and its rear wall 31 extending at an angle of about 30° to the side wall 17.

The recess 29 (see FIG. 5) in the shelf support 20 receives a U-shaped wire 32, which is welded to the side 27 of the frame of the fixed shelf 26. Each of the shelf supports 21 has are recess or gap 34 (see FIG. 7) formed in the same manner as the recess or gap 29 (see FIG. 5) is formed in the shelf support 20. The recess 34 (see FIG. 7) receives a U-shaped wire 35 (see FIG. 2), which is welded to the side 28 of the frame of the fixed shelf 26. The disposition of the U-shaped wire 32 (see FIG. 5) in the recess 29 of the shelf support 20 and the U-shaped wire 35 (see FIG. 2) in the recess 34 (see FIG. 7) of the shelf support 21 prevents movement of the fixed shelf 26 (see FIG. 2).

Accordingly, the fixed shelf 26 is retained in a fixed position on one of the shelf supports 20 (see FIG. 10) and one of the shelf supports 21 disposed in the same horizontal plane. It should be understood that more than one of the fixed shelves 26 (see FIG. 2) may be supported within the fresh food compartment 11 (see FIG. 1) of the refrigerator cabinet 10.

Figure 3:
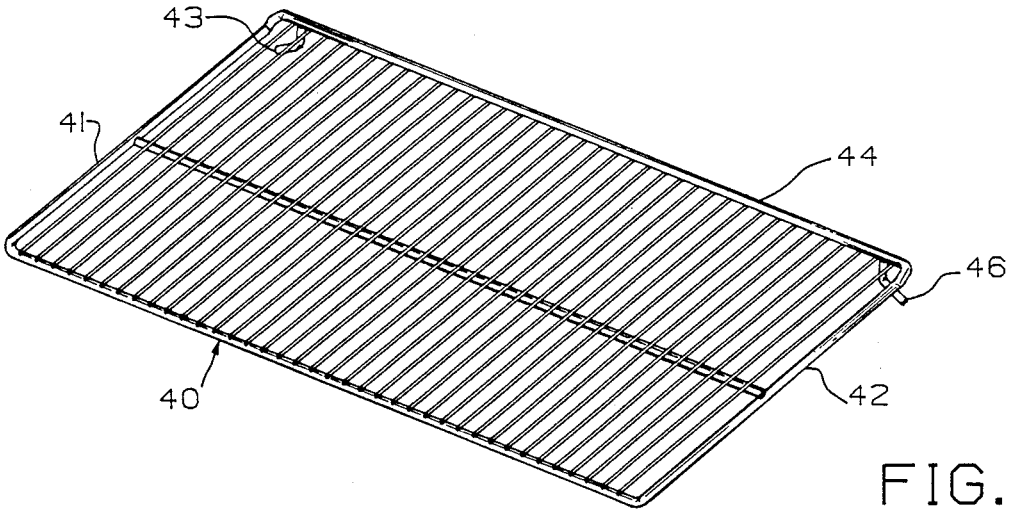
FIG. 3 is a perspective view of a slidable shelf for support by the shelf support system of the refrigerator cabinet of FIG. 1.

The shelf supports 20 and 21 (see FIG. 10) also can support a slidable shelf 40 (see FIG. 3). The slidable shelf 40 has a side 41 of its frame supported on the upper surface 22 (see FIG. 6) of the shelf support 20. The slidable shelf 40 (see FIG. 3) has a side 42 of its frame slidably supported on the upper surface 24 (see FIG. 7) of the shelf support 21 on the side wall 18 in the same horizontal plane as the shelf support 20 (see FIG. 6) supporting the side 41 of the frame of the slidable shelf 40.

Figure 6:
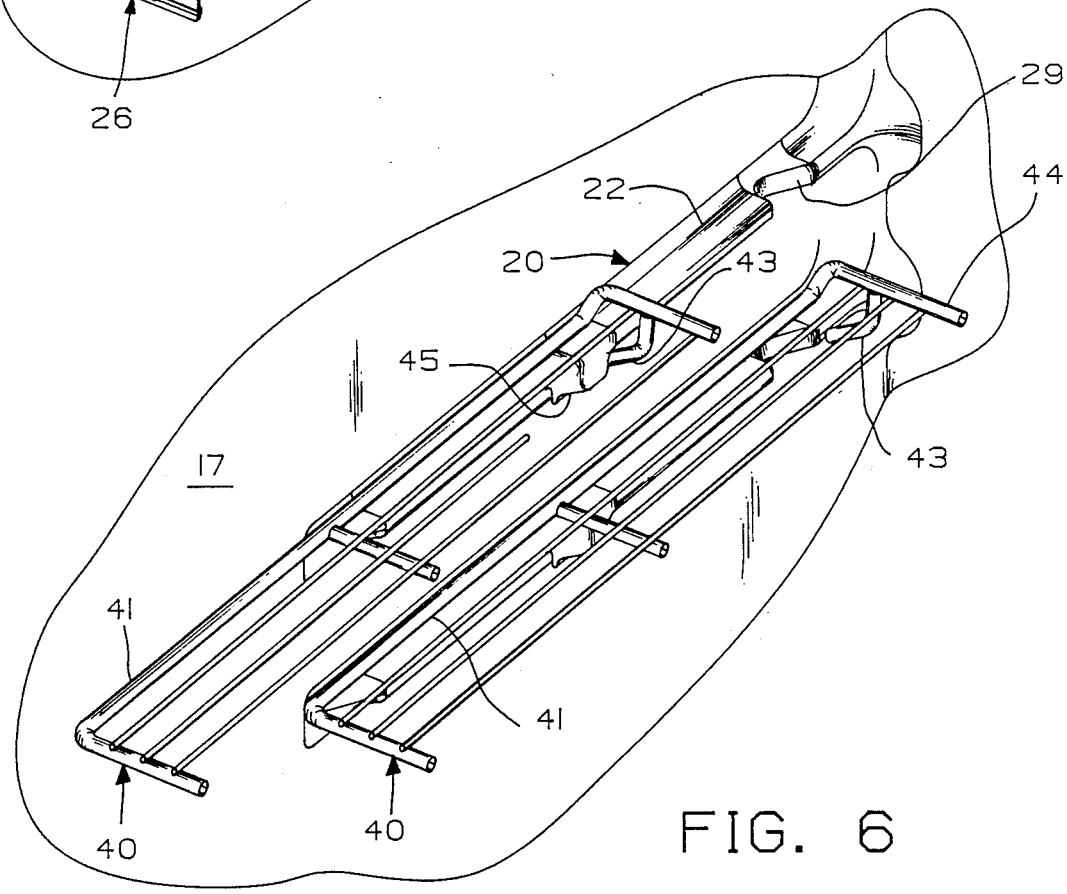
FIG. 6 is a fragmentary perspective view of two of the shelf supports on one of the side walls of the refrigerator cabinet and having two slidable shelves mounted thereon with one shelf in its forward retained position and the other shelf in its rearward position.

The forward motion of the slidable shelf 40 along the shelf support 20 is stopped by a projecting rod 43 (see FIG. 3), which extends from a rear portion 44 of the frame of the slidable shelf 40 adjacent the side 41 of the frame of the slidable shelf 40, engaging a projection 45 (see FIG. 6) extending downwardly from the shelf support 20. This stopping of the slidable shelf 40 is shown in FIG. 6 for the upper of the two slidable shelves 40.

The slidable shelf 40 (see FIG. 3) has a projecting rod 46 extending from the rear portion 44 of its frame adjacent the side 42 of the frame of the slidable shelf 40. The projecting rod 46 engages a projection 47 (see FIG. 7) extending from the shelf support 21, which is in the same horizontal plane as the shelf support 20 (see FIG. 6) supporting the side 41 of the frame of the slidable shelf 40, to stop forward motion of the slidable shelf 40.

When the refrigerator cabinet 10 (see FIG. 1) is to support a cantilever half shelf 48 (see FIG. 4), the rear wall 16 (see FIG. 1) of the refrigerator cabinet 10 has a track ladder 49 (see FIG. 10) attached thereto by suitable means such as screws 50, for example. The track ladder 49 has a plurality of vertically aligned openings 51 therein with each of the openings 51 having notches 52 and 53 in its bottom surface.

Figure 4:
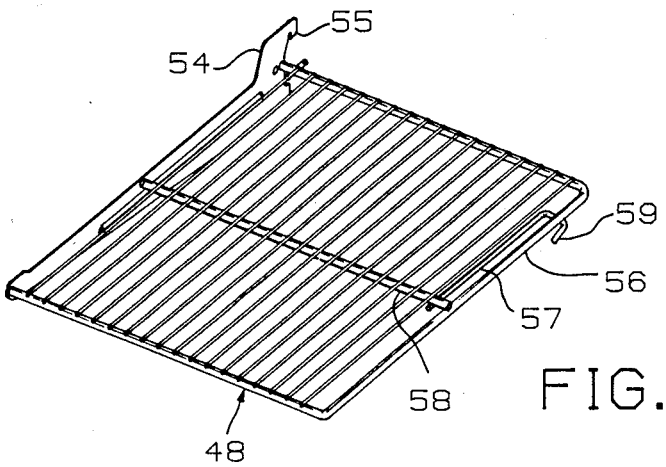
FIG. 4 is a perspective view of a cantilever half shelf for support by a shelf support on one of the side walls of the refrigerator cabinet of FIG. 1 and a track ladder mounted on the rear wall of the refrigerator cabinet of FIG. 1.

When the cantilever half shelf 48 (see FIG. 4) has its mounting bracket 54 as shown in FIG. 4, the cantilever half shelf 48 is supported by only one of the shelf supports 21 (see FIG. 10) with the mounting bracket 54 (see FIG. 4) having its hook 55 disposed in the notch 53 (see FIG. 10) in the bottom of one of the openings 51 in the track ladder 49. The cantilever half shelf 48 (see FIG. 4) has a side 56 of its frame supported on the upper surface 24 (see FIG. 7) of the shelf support 21 so that the cantilever half shelf 48 is in a horizontal plane.

The cantilever half shelf 48 (see FIG. 4) has a rod 57 welded to an intermediate support rod 58 and to the side 56 of its frame. The rod 57 has an end portion 59 disposed within the recess 34 (see FIG. 7) in the shelf support 21 to prevent the cantilever half shelf 48 from swinging off of the shelf support 21 through the end portion 59 engaging the front wall of the recess 34 if the cantilever half shelf 48 tries to pivot about the hook 55 (see FIG. 4).

Thus, the recess 34 (see FIG. 7) in the shelf support 21 serves two functions. One is to prevent the cantilever half shelf 48 from being removed from its support on the shelf support 21, and the other is to hold the fixed shelf 26 (see FIG. 2) on the shelf support 21 (see FIG. 7). The recess 29 (see FIG. 5) in the shelf support 20 functions in the same manner as the recess 34 (see FIG. 7) in the shelf support 21, but the cantilever half shelf 48 has the bracket 54 (see FIG. 4) and the rod 57 on opposite sides of the cantilever half shelf 48 from FIG. 4. Thus, the hook 55 would be disposed in the notch 52 (see FIG. 10) of one of the openings 51 in the track ladder 49 when the cantilever half shelf 48 (see FIG. 4) is supported by one of the shelf supports 20 (see FIG. 1).

Accordingly, the refrigerator cabinet 10 may be formed with the shelf supports 20 and 21 (see FIG. 7) irrespective of whether the refrigerator cabinet 10 (see FIG. 1) is to support the fixed shelf 26 (see FIG. 2), the slidable shelf 40 (see FIG. 3), or the cantilever half shelf 48 (see FIG. 4). The use of the cantilever half shelf 48 also requires that the rear wall 16 (see FIG. 1) of the refrigerator cabinet 10 have the track ladder 49 (see FIG. 10) mounted thereon. The cantilever half shelves 48 (see FIG. 4) could be staggered if desired or each pair can be in the same horizontal plane.

While the refrigerator cabinet 10 (see FIG. 1) has been shown and described as having the shelf supports 20 molded integrally with the side wall 17 of the liner 14 and the shelf supports 21 (see FIG. 7) molded integrally with the side wall 18 of the liner 14 (see FIG. 1), it should be understood that such is not a requisite for satisfactory operation. That is, the shelf supports 20 could be mounted on the side wall 17 by suitable means such as screws, for example, rather than being integral therewith, and the shelf supports 21 (see FIG. 7) could be mounted on the side wall 18 by suitable means such as screws, for example, rather than being integral therewith.

An advantage of this invention is that it reduces the manufacturing costs of refrigerator cabinets where different models support different types of shelves. Another advantage of this invention is that it decreases the time for manufacturing. A further advantage of this invention is that a single shelf support system may be utilized with either split shelves or full shelves. Still another advantage of this invention is that a stationary shelf cannot be accidentally pulled out by a user.

For purposes of exemplification, a particular embodiment of the invention has been shown and described according to the best present understanding thereof. However, it will be apparent that changes amd modifications in the arrangement and construction of the parts thereof may be resorted to without departing from the spirit and scope of the invention.

I claim:

1. A refrigerator cabinet including:

a liner including a pair of substantially parallel side walls, a rear wall, a top wall, and a bottom wall;

a cooling compartment defined by said liner and having its walls constituted by said walls of said liner;

said liner having a plurality of shelf support means mounted on each of said substantially parallel side walls constituting side walls of said cooling compartment defined by said liner, each of said shelf support means mounted on one of said side walls of said liner being in the same horizontal plane as one of said shelf support means mounted on the other of said side walls;

each of said shelf support means including an upper surface;

each of said shelf support means having stop means for preventing removal of a fixed shelf supported on said upper surface by cooperating with a portion of the fixed shelf supported on said upper surface of said shelf support means;

each of said shelf support means having limit means for limiting forward motion of a slidable shelf supported on said upper surface of said shelf support means by cooperating with a portion of the slidable shelf supported on said upper surface of said shelf support means;

support means mounted on said rear wall of said liner for supporting one side of a cantilever half shelf having its other side supported by said upper surface of one of said shelf support means mounted on one of said side walls of said liner, said rear wall of said liner constituting a rear wall of said cooling compartment defined by said liner;

and said stop means of each of said shelf support means including preventing means for preventing swinging of the cantilever half shelf supported on said upper surface of said shelf support means by cooperating with a portion of the cantilever half shelf supported on said upper surface of said shelf support means.

2. The refrigerator cabinet according to claim 1 in which said stop means of each of said shelf support means includes receiving means in said shelf support means for receiving a portion of a fixed shelf for preventing removal of a fixed shelf when said upper surface of said shelf support means has a fixed shelf supported thereon and for receiving a portion of a cantilever half shelf when said upper surface of said shelf support means has a cantilever half shelf supported thereon for preventing swinging of the cantilever half shelf supported thereon.

3. The refrigerator cabinet according to claim 2 in which:

said limit means for limiting forward motion of a slidable shelf supported on said upper surface of said shelf support means includes a projection extending downwardly from said shelf support means;

and said projection is disposed forwardly of said receiving means of said shelf support means.

4. The refrigerator cabinet according to claim 3 in which each of said shelf support means is molded integrally with said liner to form a single piece.

5. The refrigerator cabinet according to claim 4 in which said receiving means of each of said shelf support means includes a recess in said shelf support means.

6. The refrigerator cabinet according to claim 3 in which said receiving means of each of said support means includes a recess in said shelf support means.

7. The refrigerator cabinet according to claim 2 in which said receiving means of each of said shelf support means includes a recess in said shelf support means.

8. A refrigerator cabinet including:

a liner including a pair of substantially parallel side walls, a rear wall, a top wall, and a bottom wall;

a cooling compartment defined by said liner and having its walls constituted by said walls of said liner;

said liner having a plurality of shelf support means mounted on each of said substantially parallel side walls constituting side walls of said cooling compartment defined by said liner, each of said shelf support means mounted on one of said side walls of said liner being in the same horizontal plane as one of said shelf support means mounted on the other of said side walls for supporting a shelf in a horizontal plane;

each of said shelf support means including an upper surface;

a fixed shelf and a slidable shelf interchangeably supported on said upper surface of one of said shelf support means on each of said side walls in the same horizontal plane;

each of said shelf support means having stop means for preventing removal of said fixed shelf when said fixed shelf is supported on said upper surface of one of said shelf support means on each of said side walls in the same horizontal plane, said fixed shelf having means for cooperating with said stop means of said shelf support means on each of said side walls;

and each of said shelf support means having limit means for limiting forward motion of said slidable shelf when said slidable shelf is supported on said upper surface of said shelf support means on each of said side walls, said slidable shelf having means for cooperating with said limit means of said shelf support means on each of said side walls.

9. The refrigerator cabinet according to claim 8 in which said stop means for preventing removal of a fixed shelf supported on said upper surface of said shelf support means includes receiving means in said shelf support means to receive a portion of the fixed shelf supported on said upper surface of said shelf support means.

10. The refrigerator cabinet according to claim 9 in which:

said limit means for limiting removal of a slidable shelf supported on said upper surface of said shelf support means includes a projection extending downwardly from said shelf support means;

and said projection is disposed forwardly of said receiving means in said shelf support means.

11. The refrigerator cabinet according to claim 8 in which each of said shelf support means is molded integrally with said liner to form a single piece.

12. The refrigerator cabinet according to claim 9 in which said receiving means of each of said shelf support means includes a recess in said shelf support means.

13. The refrigerator cabinet according to claim 8 in which:

each of said shelf support means mounted on said one side wall is mounted solely on said one side wall;

and each of said shelf support means mounted on said other side wall is mounted solely on said other side wall and not connected to any of said shelf support means mounted on said one side wall.

* * * * *

UNITED STATES PATENT AND TRADEMARK OFFICE

CERTIFICATE OF CORRECTION

PATENT NO. : 4,904,032

DATED : Feb. 27, 1990

INVENTOR(S) : Thomas E.Jenkins

It is certified that error appears in the above-identified patent and that said Letters Patent is hereby corrected as shown below:

Column 6, line 25, before the word "support" insert --shelf--.

Signed and Sealed this

Tenth Day of September, 1991

*Attest:*

HARRY F. MANBECK, JR.

*Attesting Officer*

*Commissioner of Patents and Trademarks*